United States Patent [19]

Miura et al.

[11] 4,063,129

[45] Dec. 13, 1977

[54] MAGNETRON HAVING IMPROVED MAGNETIC FIELD DISTRIBUTION IN THE INTERACTION SPACE AND ONE STRAP OF MAGNETIC AND ELECTRICAL CONDUCTIVE MATERIAL

[75] Inventors: Hiroshi Miura, Tokyo; Norio Tashiro, Yokohama, both of Japan

[73] Assignee: Tokyo Shibaura Electric Co., Ltd., Japan

[21] Appl. No.: 680,441

[22] Filed: Apr. 26, 1976

[30] Foreign Application Priority Data

Apr. 25, 1975 Japan ..... 50-50347

[51] Int. Cl.[2] ..... H01J 25/50

[52] U.S. Cl. ..... 315/39.71; 315/39.69; 315/39.75

[58] Field of Search ..... 315/39.71, 39.69, 39.53, 315/39.51, 39.75, 5.35

[56] References Cited

U.S. PATENT DOCUMENTS

| | | | |
|---|---|---|---|
| 3,289,037 | 11/1966 | Whitmore | 315/39.69 X |
| 3,984,725 | 10/1976 | Cook et al. | 315/39.71 |

FOREIGN PATENT DOCUMENTS

| | | | |
|---|---|---|---|
| 427,954 | 5/1935 | United Kingdom | 315/39.71 |

*Primary Examiner*—Saxfield Chatmon, Jr.
*Attorney, Agent, or Firm*—Oblon, Fisher, Spivak, McClelland & Maier

[57] ABSTRACT

A magnetron which has a plurality of vanes defining resonant cavities in an anode cylinder and straps connecting equipotentially alternate vanes and is provided at both ends of the anode cylinder with a device for generating a magnetic field in an interaction space in an axial direction of the anode cylinder. The straps are made of magnetic material.

6 Claims, 14 Drawing Figures

MAGNETRON HAVING IMPROVED MAGNETIC FIELD DISTRIBUTION IN THE INTERACTION SPACE AND ONE STRAP OF MAGNETIC AND ELECTRICAL CONDUCTIVE MATERIAL

BACKGROUND OF THE INVENTION

This invention relates to a magnetron, and more particularly to a structure for improving magnetic field distribution in an interaction space.

Magnetrons used for a microwave oven generate microwave energy from a magnetic field which is generated in an interaction space of a magnetic device. In general, the magnetron is comprised of magnets, yokes connecting magnetically with each magnet, pole pieces disposed at both ends of a magnetron body, a plurality of spaced radial vanes projecting inwardly within an anode cylinder and a cathode coaxially disposed in the anode cylinder. It is necessary for stabilizing the oscillation of the magnetron tube that the direction of the magnetic field in the interaction space generated by the magnetic device acting onto the magnetron body should coincide exactly with the direction of the anode cylinder axis and that the magnetic field distribution should preferrably be uniform. The pole piece is provided for this purpose, so as to make the magnetic field uniform and parallel to the anode cylinder axis. It is however difficult actually to make the magnetic field sufficiently uniform. Especially, this defect appears in magnetrons which have magnets within the magnetron body and do not have a pole piece for adjusting the magnetic field distribution. This type magnetron has a magnet which is disposed closely to an interaction space between the ends of vanes and the cathode and the magnet may be small for obtaining an effective magnetic device so the uniformity of the magnetic field degrades. Therefore the object of this invention is to obtain an improved magnetron having a field correcting means.

SUMMARY OF THE INVENTION

In accordance with this invention there provides a magnetron with stable oscillation.

According to this invention, the magnetron comprises an anode structure comprised of an anode cylinder, a plurality of inwardly projecting spaced radial vanes defining resonant cavities therebetween within the cylinder, a concentrically positioned cathode within the cylinder spaced from the ends of the vanes defining an interaction space between the cathode and the vanes, the cathode emitting electrons into the interaction space, a plurality of straps coupling alternately the vanes adjacent their opposite remote ends from the cathode, and magnetic field generating means inducing a magnetic field in the axial direction of the anode cylinder in the interaction space, wherein said straps are made at least partially of magnetic material and the magnetic field distribution in the interaction space is aligned substantially parallel to the axial direction.

DESCRIPTION OF THE PREFERRED EMBODIMENTS

Figure 1:
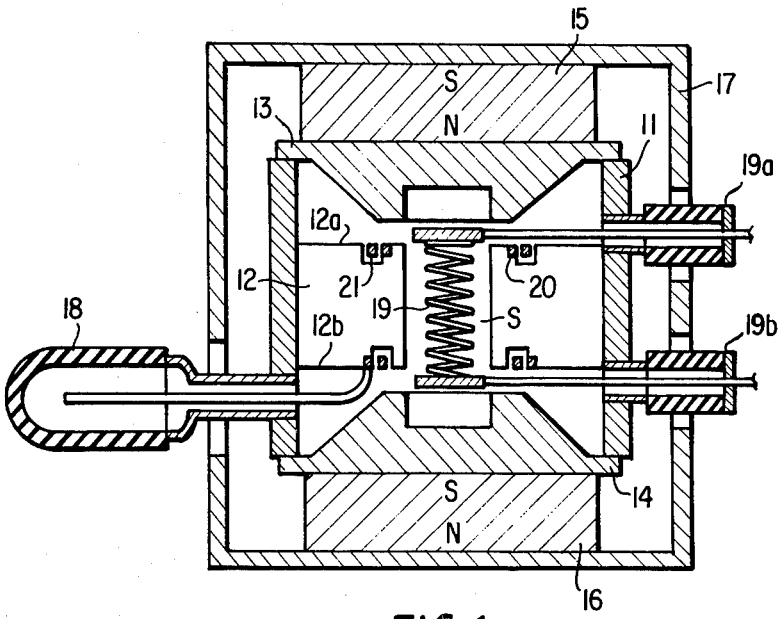
FIG. 1 is a longitudinal sectional view showing schematically an embodiment of this invention.

Referring to FIG. 1,3,4 and 5 a detailed description will now be made with of an embodiment of this invention. There is shown a magnetron which has an copper anode cylinder 11, a plurality of inwardly projecting spaced radial copper vanes 12 defining resonant cavities therebetween within the cylinder 11, a concentrically positioned directly heated cathode 19 within the cylinder 11 spaced from the ends of the vanes 12 defining an interaction space S between the cathode 19 and the vanes 12, emitting electrons into the interaction space S, ring-shaped magnet straps or bands 20, 21 disposed at both remote ends 12*a*, 12*b* of the vanes 12 from the cathode 19, truncated cone shaped iron pole pieces 13, 14 closing hermetically both ends of the cylinder 11 and permanent magnet disks 15, 16 disposed on the outer surfaces of the pole pieces 13, 14.

Straps 20 and 21 couple alternate vanes equipotentially, so as to stabilize magnetron oscillation. Preferably two straps are provided per each vanes end of vanes. The two straps connect alternate vanes and act as conductive elements holding alternate vanes at equal RF potentials.

Figure 3:
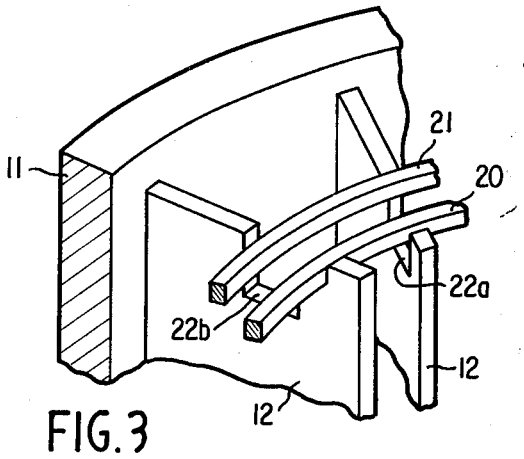
FIG. 3 is a perspective view showing an enlarged portion of FIG. 1.

L-shaped grooves 22*a* having step portions 22*c* distant from the cathode 19 and reverse L-shaped grooves 22*b* having step portions 22*d* near the cathode 19 are provided at the remote ends 12*b*, 12*a* of the vanes 12 from the cathode 19 to support the magnet straps 20, 21. As best seen in FIG. 3, the vanes 12 which have the grooves 22*a*, 22*b* respectively are disposed radially in such a way that the grooves 22*a*, and 22*b* are positioned alternately. As the small diameter magnet straps 20 and the larger diameter straps 21 are slipped into the grooves 22*a*, 22*b* the straps 20 are in contact with the grooves 22*b* at the step portions 22*d* and not in contact with the grooves 22*a*, while the straps 21 are in contact with the grooves 22*a* at the step portions 22*c* and not in contact with the grooves 22*b*. The straps 20, 21 are made of permanent magnet material having high electrical conductivity such as copper, nickel and iron, so they act as conductive elements. In this way, the magnet straps 20, 21 maintain equal RF potentials on of the alternate vanes and stabilize the $\pi$ mode oscillation of the magnetron.

The permanent magnet disks 15, 16 and the pole pieces 13, 14 are surrounded by an iron yoke 17 forming a return path for magnetic flux generated by the permanent magnet disks 15, 16. When the permanent magnet disks 15, 16 are magnetized in the polarity as seen in FIG. 1, the direction of the magnetic field in the interaction space S is downward as seen also in FIG. 1.

Electrons emitted from the coil-shaped directly heated cathode 19 circle around the cathode 19 by the action of the magnetic field and the electric field in the intraction space S, contributing RF (as 2,450 MHz) oscillation. This interaction space S has to be kept in vacuum state. Here a member denoted by a numeral 18 is an output antenna and members denoted by symbols 19*a*, 19*b* are stems supporting the cathode 19.

Figure 4:
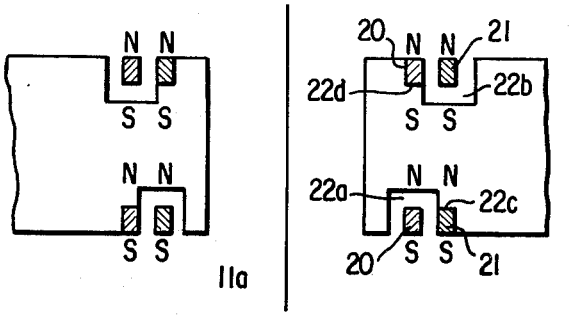
FIG. 4 is a schematic view showing an outline of the vanes and the straps, to explain the action of the embodiment in FIG. 1.
Figure 5:
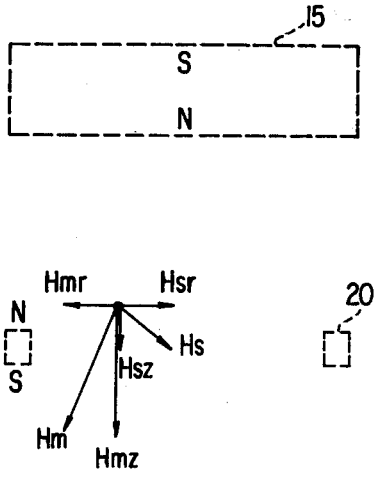
FIG. 5 is a vector diagram showing components of magnetic field.

In this embodiment, all the magnet straps 20, 21 disposed in the grooves 22*a*, 22*b* are magnetized in the same polarity (their south poles downward) as seen in FIG. 4. Now, reffering to FIG. 5, the axial component H*sz* of the magnetic field Hs generated by the straps 20, 21 is added to the axial component Hmz of the magnetic field H*m* generated by the permanent magnet disks 15, 16, while the radial component H*sr* of the magnetic field H*s* and the radial component H*mr* of the magnetic field H*m* tend to cancel each other favourably. Then stable oscillation of the magnetron can be achieved.

Alternatively, for the adjustment of the magnetic field in the interaction space generated from a pair of permanent magnet disks, various structures are illustrated in FIG. 6. Namely in FIG. 6A a pair of two magnet rings 20*a*, 21*a* with inverse polarity with respect to each other parallel to the cylinder axis 11*a* are positioned adjacent each end of the anode vanes 12. In FIG. 6B are positioned two magnet ring straps 20*b* and 21*b* whose magnetic directions make a right angle with respect to each other. In FIG. 6C are assembled a pair of straps of permanent magnet and soft magnetic material (such as iron) 20*c*, 21*c* respectively. This strap 21*c* also can be made of ferro-magnetic material. And as shown in FIG. 6D, there are disposed a small diameter ring strap 20*d* of ferro-magnetic material such as iron and a large diameter ring strap 21*d* of highly conductive material such as copper, adjacent the groove cut at each end of the vane. The ring strap 21*d* serves conveniently as an adjusting means of the oscillated frequency.

Figure 7A:
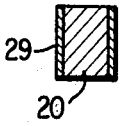
FIG. 6A, 6B, 6C, 6D and FIG. 7A, 7B, 7C are still another embodiments of this invention.
Figure 7B:
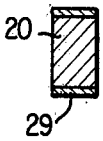

The magnet ring strap and magnetic material ring strap as shown in FIG. 7A and 7B, may be realized by depositing highly conductive material layer 29 such as copper on a part of the surface of a ring of magnetic material such as iron, so as to achieve the above mentioned effect.

Figure 2:
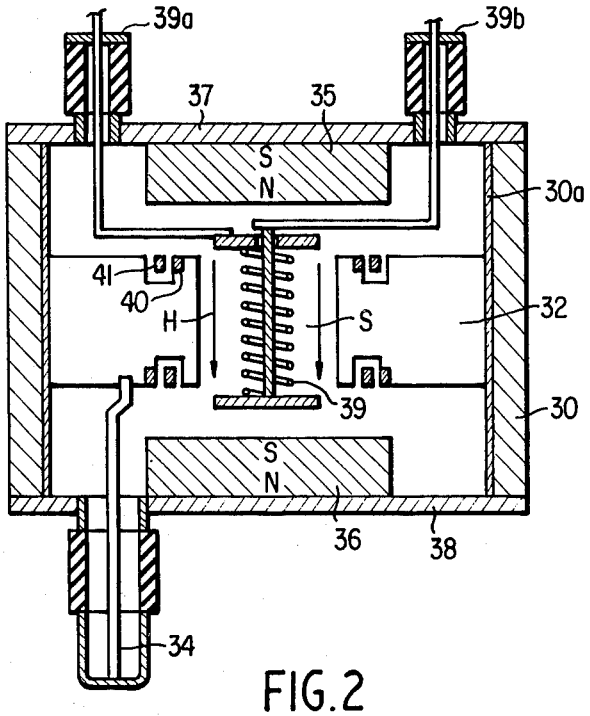
FIG. 2 is a schematic longitudinal sectional view of another embodiment of this invention.

FIG. 2 illustrates another embodiment of this invention, wherein the magnetron structure has a pair of permanent magnets 35, 36 of rare earth element composition such as samarium cobalt, cerium cobalt facing each other without pole pieces.

These magnets are positioned coaxially on the cylinder axis to which a cathode 39 extends therebetween. The numeral 34 denotes an output antenna and members denoted by symbols 39*a*, 39*b* are stems for holding a cathode 39. The anode cylinder 30 is made of magnetic material such as iron and its inner surface is covered with a copper layer 30*a*. A plurality of inwardly projecting spaced radial copper vanes 32 are disposed within the cylinder 30. The cylinder 30 hermetically closed with iron yoke plates 37, 38 having the permanent magnets 35, 36 on their inner surface not only serves as the anode cylinder but also functions as the return path of the magnetic flux generated by the permanent magnets 35, 36. Ring-shaped straps 40, 41 of magnetic material such as iron are disposed adjacent the lower and upper ends of the vanes 32 remote from the cathode 39 and the straps 40, 41 adjust the direction of the magnetic field H in the interaction space S generated by the magnets 35, 36 to be parallel to the cylinder axis and the magnetic field distribution to be uniform.

Figure 7C:
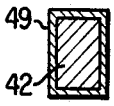
Figure 6A:
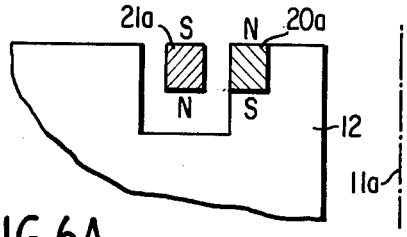
Figure 6B:
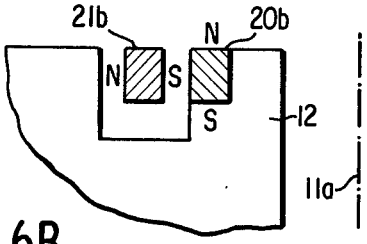
Figure 6C:
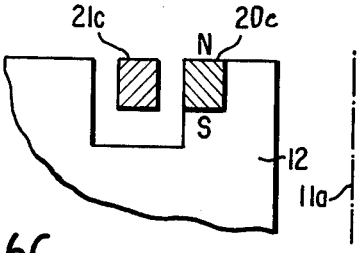
Figure 6D:
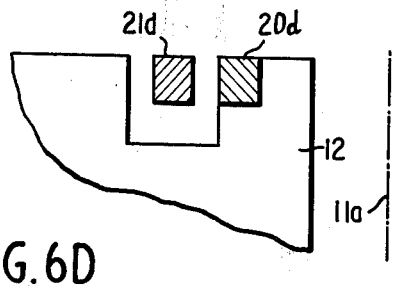

As shown in FIG. 7C, it is favourable to cover the whole surface of a strap 42 of magnetic material with a metal layer 49 having high electric conductivity for reducing RF dissipation on the surface of the strap 42.

Figure 8:
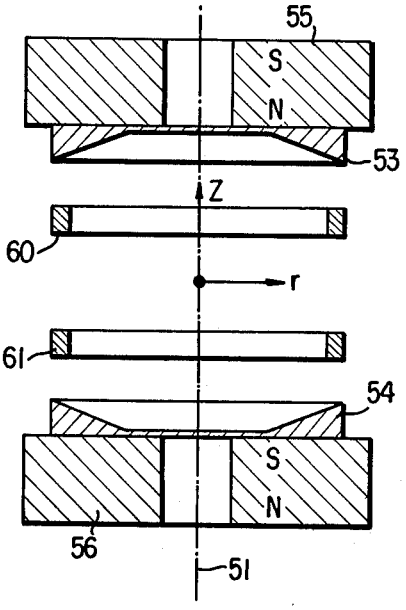
FIG. 8 is a schematic sectional view of still another embodiment of this invention.
Figure 9:
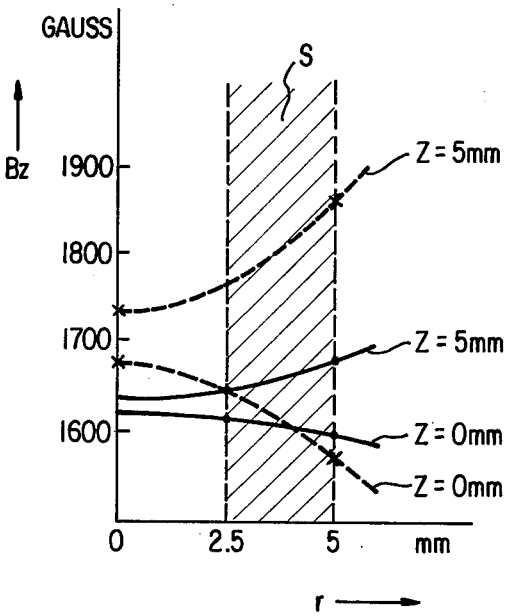
FIG. 9 is a graph of the magnetic field intensity in the direction of anode cylinder axis versus the radial distance from the anode cylinder axis in the embodiment in FIG. 8.

Referring to FIG. 8 and 9, a description will be made with respect to another embodiment of this invention. In FIG. 8 there are shown only the main parts of a magnetron forming the magnetic field in the interaction space S in order to describe the characteristics thereof more clearly. A pair of ring-shaped permanent magnets 55, 56 facing each other are disposed coaxially with the cylinder axis 51. Iron pole pieces 53, 54 are disposed on each facing surface of the magnets 55, 56 also coaxially with the cylinder. The pole piece 53 or 54 have a recessed portion on each surface facing the interaction space S. The dimensions of the magnets 55, 56 are 6mm in thickness, 20mm in outer diameter, 5mm in inner diameter and the spacing between the magnets is 7mm, less than the outer diameter of the magnets. The pole pieces are made of annular iron plates with 2mm thickness. Ring-shaped iron straps 60, 61 having the dimensions of 17mm in outer diameter, 15mm in inner diameter and 1.5mm in thickness are disposed between the pole pieces 53, 54 coaxially with the cylinder axis 51. The pole pieces 53, 54 and the straps 60, 61 contribute to improve the uniformity of the magnetic field distribution in the interaction space S. FIG. 9 is a graph of the magnetic field intensity Bz in the direction of the cylinder axis 51 versus the radial distance *r* from the cylinder axis 51 in the embodiment shown in FIG. 8. The displacement from the middle of the interaction space S in the direction of the cylinder axis 51 is symbolized with z. In FIG. 9 the magnetic field intensity Bz illustrated with solid lines ranges from 1600 gauss to 1700 gauss in the hatched zone S corresponding to the interaction space S, where Bz is measured at the surface of $z = 0$ and 5mm respectively. In FIG. 9 the magnetic field intensity Bz is illustrated with dotted lines when the straps 60, 61 are removed from the structure shown in FIG. 8 and Bz ranges in this case from 1580 gauss to 1860 gauss in the zone S. From this result, it is obvious that a fair uniformity of magnetic field distribution is obtained in this embodiment.

As above detailed, this invention can provide a very effectual magnetron for microwave ovens, whose stability is improved as a result of correcting the direction of the magnetic field and the uniformity of the magnetic field distribution in the interaction space by employing straps made of magnetic material or permanent magnets. That is especially effective in a compact magnetron whose magnets are disposed to the interaction space.

Moreover, this invention includes various modifications containing the essential points described in the embodiments.

What we claim is:

1. A magnetron comprising:

an anode cylinder, a plurality of inwardly projecting spaced radial vanes defining resonant cavities therebetween within the cylinder, a concentrically positioned cathode within the cylinder spaced from the ends of the vanes defining an interaction space between the cathode and the vanes, the cathode emitting electrons into the interaction space, a plurality of straps at least one of which is comprised of magnetic and electrically conductive material coupling alternate ones of the vanes at their ends adjacent the cathode to maintain equal RF potentials on alternate vanes, and magnetic field generating means for inducing a magnetic field in the axial direction of the cylinder in the interaction space, whereby the magnetic field distribution in the interaction space is aligned substantially parallel to the axial direction.

2. A magnetron according to claim 1 wherein the magnetic field generating means comprises a pair of permanent magnet members of rare earth composition.

3. A magnetron according to claim 1 wherein each vane at one end has a groove supporting a pair of straps, at least one of the straps being magnetized parallel to the axial direction.

4. A magnetron according to claim 1 wherein the magnetic field generating means comprises a pair of permanent magnet members, a pair of pole pieces attached adjacent to each permanent magnet member and a magnetic flux return path member surrounding the magnet members and the pole pieces.

5. A magnetron according to claim 1 wherein the anode cylinder comprises a wall of magnetic material, the wall acting as a magnetic return path.

6. A magnetron according to claim 4 wherein the permanent magnet members are of the disc type and face each other and the distance therebetween is less than the outer diameter of the members.

* * * * *